US009230490B2

(12) United States Patent
Hu et al.

(10) Patent No.: US 9,230,490 B2
(45) Date of Patent: Jan. 5, 2016

(54) LED BACKLIGHT DRIVER CIRCUIT

(71) Applicant: SHENZHEN CHINA STAR OPTOELECTRONICS TECHNOLOGY CO., LTD, Shenzhen (CN)

(72) Inventors: Anle Hu, Shenzhen (CN); Xiang Yang, Shenzhen (CN)

( * ) Notice: Subject to any disclaimer, the term of this patent is extended or adjusted under 35 U.S.C. 154(b) by 465 days.

(21) Appl. No.: 13/809,448

(22) PCT Filed: Dec. 26, 2012

(86) PCT No.: PCT/CN2012/087545

§ 371 (c)(1),
(2) Date: Jan. 10, 2013

(87) PCT Pub. No.: WO2014/101005

PCT Pub. Date: Jul. 3, 2014

(65) Prior Publication Data

US 2014/0176014 A1 Jun. 26, 2014

(51) Int. Cl.
*G09G 3/34* (2006.01)

(52) U.S. Cl.
CPC ..... *G09G 3/3426* (2013.01); *G09G 2330/02* (2013.01)

(58) Field of Classification Search
CPC .. G09G 3/3406; H05B 37/00; H05B 33/0887; H05B 33/0827; H05B 33/083
USPC ..... 315/209 R, 210, 247, 291, 308, 307, 315/186, 192; 345/102
See application file for complete search history.

(56) References Cited

U.S. PATENT DOCUMENTS

| | | | | |
|---|---|---|---|---|
| 7,919,928 | B2 * | 4/2011 | Ziegenfuss | 315/227 R |
| 2005/0007085 | A1 | 1/2005 | Murakami | |
| 2007/0097067 | A1 | 5/2007 | Yoo | |
| 2009/0195163 | A1 * | 8/2009 | Nguyen et al. | 315/122 |
| 2010/0201283 | A1 * | 8/2010 | Kawata et al. | 315/287 |
| 2011/0018914 | A1 * | 1/2011 | Ishikawa et al. | G09G 3/3426 345/691 |
| 2011/0227497 | A1 * | 9/2011 | Hu et al. | H05B 33/0809 315/224 |
| 2012/0104964 | A1 * | 5/2012 | Hughes | H05B 33/0848 315/291 |
| 2012/0181939 | A1 * | 7/2012 | Szczeszynski et al. | H05B 33/0815 315/186 |
| 2012/0268022 | A1 * | 10/2012 | Liu et al. | 315/192 |

FOREIGN PATENT DOCUMENTS

| | | | |
|---|---|---|---|
| CN | 1760721 | A | 4/2006 |
| CN | 1956045 | A | 5/2007 |
| CN | 101681974 | A | 3/2010 |
| CN | 101882424 | A | 11/2010 |
| CN | 102186276 | A | 9/2011 |
| CN | 102254526 | A | 11/2011 |
| CN | 102637412 | A | 8/2012 |
| CN | 202394501 | U | 8/2012 |
| WO | WO2008004997 | A1 | 1/2008 |

OTHER PUBLICATIONS

Liu Chang, the International Searching Authority written comments, Sep. 2013, CN.

* cited by examiner

*Primary Examiner* — Jimmy Vu
*Assistant Examiner* — Wei Chan

(57) ABSTRACT

A light emitting diode (LED) backlight driver circuit includes an LED lightbar and a driver module of the LED lightbar. The driver module includes a backlight driver integrated chip (IC) regulating an output voltage of the driver module, and the backlight driver IC includes a first comparator correcting the output voltage of the driver module. The output end of each LED lightbar is coupled to an inverting input end of the first comparator, and a non-inverting input end of the first comparator is coupled to a protection module. The protection module includes a detection unit detecting an output current of the driver module. When the output current of the driver module detected by the detection unit is greater than a preset first current, the protection module outputs a first reference voltage to the non-inverting input end of the first comparator. When the output current of the driver module detected by the detection unit is lower than the preset first current, the protection module outputs a second reference voltage, which is lower than the first reference voltage, to the non-inverting input end of the first comparator.

12 Claims, 9 Drawing Sheets

LED BACKLIGHT DRIVER CIRCUIT

This application is a national stage application of PCT application PCT/CN2012/087545 filed on Dec. 26, 2012, which is based on and claims priority to Chinese patent application 201210569947.5 filed on Dec. 25, 2012 in China. The entirety of each of the above-mentioned applications is hereby incorporated by reference herein in its entirety.

TECHNICAL FIELD

The present disclosure relates to the field of liquid crystal displays (LCDs), and more particularly to a light emitting diode (LED) backlight driver circuit.

BACKGROUND

A typical liquid crystal display (LCD) device employs light emitting diodes (LEDs) as a backlight source. A plurality of LED lights are connected in series to form an LED lightbar, and the LED lightbar is coupled to a boost circuit. As shown in FIG. 1, a controllable switch Q of the boost circuit is coupled to a backlight driver integrated chip (IC), an output voltage of the boost circuit is regulated by regulating a duty cycle of an output signal of a driver pin G of the backlight driver IC, to dim the LED lightbar. If a plurality of LED lightbars are used, the LED lightbars may be arranged in parallel and coupled to a same boost circuit. The backlight driver IC comprises a comparator, where an output end of each LED lightbar is coupled to an inverting input end of the comparator, and a non-inverting input end of the comparator is coupled to a reference voltage. The comparator regulates the duty cycle of the output signal of the backlight driver IC according to a voltage difference between the reference voltage and each LED lightbar, thereby dimming the LED lightbar. A typical backlight driver module may exhibit poor circuit performance, for example, when the backlight driver module is still outputting a high voltage when the LED lightbars are under a light load (brightness of LED lightbars is low), resulting in efficiency reduction of backlight driver, or when the backlight driver module still outputs low voltage when the LED lightbars are under a heavy load (brightness of LED lightbars is high), resulting in that expected brightness of the LED lightbars may not be achieved

SUMMARY

The first aim of the present disclosure is to provide a light emitting diode (LED) backlight driver circuit capable of improving backlight driver efficiency when LED lightbars are under a light load.

The aim of the present disclosure is achieved by the following technical scheme.

An LED backlight driver circuit comprises an LED lightbar and a driver module of the LED lightbar. The driver module comprises a backlight driver IC regulating an output voltage of the driver module. The backlight driver IC comprises a first comparator correcting the output voltage of the driver module. An output end of each LED lightbar is coupled to an inverting input end of the first comparator, and a non-inverting input end of the first comparator is coupled to a protection module. The protection module comprises a detection unit detecting an output current of the driver module.

When the output current of the driver module detected by the detection unit is greater than a preset first current, the protection module outputs a first reference voltage to the non-inverting input end of the first comparator; when the output current of the driver module detected by the detection unit is lower than the preset first current, the protection module outputs a second reference voltage, which is lower than the first reference voltage, to the non-inverting input end of the first comparator.

Furthermore, the protection module comprises a second comparator, and the detection unit comprises a conversion assembly converting the detected current into a voltage. The conversion assembly is coupled to a non-inverting input end of the second comparator, an inverting input end of the second comparator is coupled to a third reference voltage, the first reference voltage and the second reference voltage are separately coupled to two excitation ends of the second comparator, and an output end of the second comparator is coupled to the non-inverting input end of the first comparator.

When the output current of the driver module detected by the detection unit is greater than the preset first current, the second comparator outputs the first reference voltage; when the output current of the driver module detected by the detection unit is lower than the preset first current, the second comparator outputs the second reference voltage. This is a specific circuit structure of the protection module. Collected current information is converted into voltage information, and the converted voltage is compared with a third reference voltage of a second input end of the second comparator, thereby determining whether the first reference voltage or the second reference voltage is output.

Furthermore, the driver module of the LED lightbars comprises an inductor coupled to a power source and a diode coupled to the inductor. A cathode of the diode is coupled to an input end of each LED lightbar, a controllable switch regulating voltage and a divider resistor are in series connection between an anode of the diode and a ground end of the power source in sequence, a control end of the controllable switch regulating voltage is coupled to the backlight driver IC, and an end voltage of the divider resistor is coupled to a non-inverting input end of the second comparator. This is a topology structure of a driver module using a boost circuit. Where there is a direct linear relation between the current flowing through the divider resistor of the boost circuit and the output current of the driver module. Therefore, the end voltage of the divider resistor may be coupled to the second comparator to achieve function of the conversion assembly of the detection unit. Thus, the divider resistor achieves voltage collection function of the conversion assembly in addition to achieving function of the boost circuit; thus, the circuit is simple, reusability of devices is high, and reducing costs.

Furthermore, the protection module further comprises a third comparator. The conversion assembly of the detection unit is coupled to a non-inverting input end of the third comparator, an inverting input end of the third comparator is coupled to a fourth reference voltage, an output end of the second comparator is coupled to a first excitation end of the third comparator, and a second excitation of the third comparator is coupled to a fifth reference voltage. The fourth reference voltage is greater than the third reference voltage, and the fifth reference voltage is greater than the first reference voltage.

When the output current of the driver module detected by the detection unit is greater than a preset second current, the fifth reference voltage output by the third comparator is coupled to the non-inverting input end of the first comparator. The second current is greater than the first current. The technical scheme expands function of the protection module. When a typical driver module outputs a heavy load (when a current flowing through the LED lightbars is great and brightness of LED lightbars is great), the voltage of the output end of each LED lightbar is increased, the voltage of the inverting input end of the first comparator coupled to the output end of the LED lightbar is increased, and a voltage difference between the inverting input of the first comparator and the first reference voltage is reduced. At this moment, the backlight driver IC may reduce a duty cycle of an output signal of a driver pin G of the backlight driver IC and reduce the output voltage of the driver module, which causes that the voltage may be overlow under the heavy load, and then expected brightness of the LED lightbars may be not achieved. The protection module outputs the fifth reference voltage as needed under the heavy load, the fifth reference voltage is greater than the first reference voltage. Thus, a voltage difference between the inverting input end and the non-inverting input end of the first comparator is increased as well. The backlight driver IC may increase the duty cycle of the output signal of the driver pin G of the backlight driver IC and increase the output voltage of the driver module, to output high voltage under the heavy load so as to enable the LED lightbars to achieve the expected brightness.

Furthermore, the driver module of the LED lightbars comprises an inductor coupled to a power source and a diode coupled to the inductor. A cathode of the diode is coupled to an input end of each LED lightbar, a controllable switch regulating voltage and a divider resistor are in series connection between an anode of the diode and a ground end of the power source in sequence, a control end of the controllable switch regulating voltage is coupled to the backlight driver IC, and an end voltage of the divider resistor is coupled to the non-inverting input ends of the second comparator and the third comparator. This is a topology structure of a driver module using a boost circuit. Where there is a direct linear relation between the current flowing through the divider resistor of the boost circuit and the output current of the driver module. Therefore, the end voltages of the divider resistor may be coupled to the second comparator and the third comparator to achieve function of the conversion assembly of the detection unit. Thus, the divider resistor achieves voltage collection function of the conversion assembly in addition to achieving function of the boost circuit; thus, the circuit is simple, reusability of devices is high, and reducing costs.

Furthermore, the first reference voltage is 0.6 V, the second reference voltage is 0.5 V, the third reference voltage is 0.25 V, the fourth reference voltage is 0.45 V, and the fifth reference voltage is 0.7 V. This is a specific group of reference voltage values, and the reference voltage values are applicable to various backlight drivers of LCD devices.

Furthermore, the backlight driver IC comprises an overcurrent protection pin; the end voltage of the divider resistor is coupled to the protection pin. The backlight driver IC may increase overcurrent protection function, and regulate output voltage when the output current of the driver module is overhigh, to prevent the LED lightbar from being burned out.

Furthermore, the driver module of the LED lightbars comprises an inductor coupled to a power source and a diode coupled to the inductor. A cathode of the diode is coupled to the input end of the LED lightbar, and a controllable switch regulating voltage and a divider resistor are in series connection between an anode of the diode and a ground end of the power source in sequence. The detection unit is the divider resistor. A control end of the controllable switch regulating voltage is coupled to the backlight driver IC. The protection module further comprises a third comparator. The end voltage of the divider resistor is coupled to the non-inverting input ends of the second comparator and the third comparator, the inverting input end of the third comparator is coupled to a fourth reference voltage, the output end of the second comparator is coupled to a first excitation end of the third comparator, and a second excitation end of the third comparator is coupled to a fifth reference voltage. The fourth reference voltage is greater than the third reference voltage, and the fifth reference voltage is greater than the first reference voltage.

This is a topology structure of a driver module using a boost circuit of the LED backlight driver circuit. Where there is a direct linear relation between the current flowing through the divider resistor of the boost circuit and the output current of the driver module. Therefore, the end voltage of the divider resistor is coupled to the non-inverting input ends of the second comparator and the third comparator to achieve function of the detection unit. Thus, the divider resistor achieves the voltage collection function of the conversion assembly in addition to achieving function of the boost circuit, thus, the circuit is simple, reusability of devices is high, and reducing costs.

A driving method of the LED backlight driver circuit mentioned above comprises step:

detecting an output current of a driver module, when the output current of the driver module is greater than a preset first current, a protection module outputs a first reference voltage to a non-inverting input end of a first comparator. Otherwise, the protection module outputs a second reference voltage, which is lower than the first reference voltage, to the non-inverting input end of the first comparator.

Furthermore, the driving method further comprises step:

setting a second current being greater than the first current, when detecting that the output current of the driver module is greater than the second current, the protection module outputs a fifth reference voltage, which is greater than the first reference voltage, to the non-inverting input end of the first comparator. The technical scheme expands function of the protection module. When a typical driver module outputs a heavy load (when a current flowing through the LED lightbars is great and brightness of LED lightbar is great), the voltage of the output end of the LED lightbar is increased, and the voltage of the inverting input end of the first comparator coupled to the output end of the LED lightbar is increased, and the voltage difference between the inverting input and the first reference voltage is reduced. At this moment, the backlight driver IC may reduce the duty cycle of the output signal of the driver pin G of the backlight driver IC and reduce the output voltage of the driver module, which causes that the voltage may be overlow under the heavy load, and expected brightness of the LED lightbars may not be achieved. The protection module outputs the fifth reference voltage as needed under the heavy load, the fifth reference voltage is greater than the first reference voltage. Thus, the voltage difference between the inverting input end and the non-inverting input end of the first comparator is increased as well. The backlight driver IC may increase the duty cycle of the output signal of the driver pin G of the backlight driver IC and increase the output voltage of the driver module, to output high voltage under the heavy load so as to enable that the LED lightbars may achieve the expected brightness.

An LCD device comprises the LED backlight driver circuit mentioned above.

In the present disclosure, the protection module is used. The protection module determines whether the LED lightbars are under a light load by detecting the output current of the driver module, and when the LED lightbar normally operates, the protection module outputs a first reference voltage to the first comparator of the backlight driver IC. When the LED lightbars are under the light load (namely a current flowing through the LED lightbars is lower than the preset first current), the voltage of the output end of each LED lightbar is reduced, the voltage of the inverting input end of the first comparator coupled to the output end of the LED lightbar is reduced, and a voltage difference between the inverting input and the first reference voltage is reduced. At this moment, the backlight driver IC may increase the duty cycle of the output signal of the driver pin G of the backlight driver IC and increase the output voltage of the driver module, which causes that the voltage may be overhigh under the light load, and efficiency of the driver module may be reduced. The protection module outputs a second reference voltage as needed under the heavy load, the second reference voltage is lower than the first reference voltage. Thus, a voltage difference between the inverting input end and the non-inverting input end of the first comparator is increased as well. The backlight driver IC may reduce the duty cycle of the output signal of the driver pin G of the backlight driver IC and reduce the output voltage of the driver module, to output a low voltage under the heavy load and increase efficiency of the driver module.

The second aim of the present disclosure is to provide an LED backlight driver circuit capable of stabilizing brightness of LED lightbars and improving the backlight driver efficiency when LED lightbars age under a heavy load.

The aim of the present disclosure is achieved by the following technical scheme.

An LED backlight driver circuit comprises an LED lightbar and a driver module of the LED lightbar. The driver module comprises a backlight driver IC regulating an output voltage of the driver module, and the backlight driver IC comprises a first comparator correcting an output voltage of the driver module. An output end of each LED lightbar is coupled to an inverting input end of the first comparator, and a non-inverting input end of the first comparator is coupled to a protection module having a variable output voltage.

The protection module comprises a detection unit detecting an output current of the driver module.

When the output current of the driver module detected by the detection unit is lower than a preset second current, the protection module outputs a first reference voltage to the non-inverting input end of the first comparator, when the output current of the driver module detected by the detection unit is greater than the preset second current, the protection module outputs a fifth reference voltage, which is greater than the first reference voltage, to the non-inverting input end of the first comparator.

Furthermore, the protection module comprises a third comparator, and the detection unit comprises a conversion assembly converting a detected current into a voltage. The conversion assembly is coupled to a non-inverting input end of the third comparator, an inverting input end of the third comparator is coupled to a fourth reference voltage, the first reference voltage and the fifth reference voltage are separately coupled to two excitation ends of the third comparator, and an output end of the third comparator is coupled to the non-inverting input end of the first comparator.

When the output current of the driver module detected by the detection unit is lower than the preset second current, the third comparator outputs a first reference voltage, when the output current of the driver module detected by the detection unit is greater than the preset second current, the third comparator outputs the fifth reference voltage. This is a specific circuit structure of the protection module. Collected current information is converted into voltage information, and the converted voltage is compared with the fifth reference voltage of the second input end of the third comparator, thereby determining whether the first reference voltage or the second reference voltage is output.

Furthermore, the backlight driver IC comprises an overcurrent protection pin. The driver module of the LED lightbar comprises an inductor coupled to a power source and a diode coupled to the inductor. A cathode of the diode is coupled to an input end of the LED lightbar, a controllable switch regulating voltage and a divider resistor are in series connection between an anode of the diode and the ground end of the power source in sequence, a control end of the controllable switch regulating voltage is coupled to the backlight driver IC, and an end voltage of the divider resistor is coupled to the non-inverting input end of the third comparator and the protection pin of the backlight driver IC. This is a topology structure of a driver module using a boost circuit. Where there is a direct linear relation between the current flowing through the divider resistor of the boost circuit and the output current of the driver module. Therefore, the end voltage of the divider resistor may be coupled to the third comparator to achieve function of the conversion assembly of the detection unit. Thus, the divider resistor achieves voltage collection function of the conversion assembly in addition to achieving function of the boost circuit, thus, the circuit is simple, reusability of devices is high, and reducing cost. The backlight driver IC may increase an overcurrent protection function, and regulate output voltage when the output current of the driver module is overhigh, to prevent the LED lightbar from being burned out.

Furthermore, the first reference voltage is 0.6 V, the fourth reference voltage is 0.45 V, and the fifth reference voltage is 0.7 V. This is a group of specific reference voltage values, and the reference voltage values are applicable to various backlight drivers of LCD devices.

Furthermore, the backlight driver IC comprises an overcurrent protection pin. The driver module of the LED lightbars comprises an inductor coupled to a power source and a diode coupled to the inductor. A cathode of the diode is coupled to an input end of each LED lightbar, and a controllable switch regulating voltage and a divider resistor are in series connection between an anode of the diode and a ground end of the power source in sequence. The detection unit is the divider resistor. A control end of the controllable switch regulating voltage is coupled to the backlight driver IC. The protection module comprises a third comparator. An end voltage of the divider resistor is coupled to a non-inverting input end of the third comparator and the protection pin of the backlight driver IC. The detection unit comprises a conversion assembly converting a detected current into a voltage. The conversion assembly is coupled to the non-inverting input end of the third comparator, an inverting input end of the third comparator is coupled to a fourth reference voltage, a first reference voltage and a fifth reference voltage are separately coupled to two excitation ends of the third comparator, and an output end of the third comparator is coupled to the non-inverting input end of the first comparator.

This is a topology structure of a driver module using a boost circuit of the LED backlight driver circuit. Where there is a direct linear relation between the current flowing through the divider resistor of the boost circuit and the output current of the driver module. Therefore, the end voltage of the divider resistor may be coupled to the non-inverting input end of the third comparator to achieve function of the detection unit. Thus, the divider resistor achieves voltage collection function of the conversion assembly in addition to achieving function of the boost circuit, thus, the circuit is simple, reusability of devices is high, and reducing costs.

A driving method of the LED backlight driver circuit mentioned above comprises step:

Detecting an output current of the driver module, when the output current of the driver module is lower than a preset first current, a protection module outputs a first reference voltage to a non-inverting input end of a first comparator. Otherwise, the protection module outputs a fifth reference voltage, which is greater than the first reference voltage, to the non-inverting input end of the first comparator.

An LCD device comprises the LED backlight driver circuit mentioned above.

In the present disclosure, the protection module is used. The protection module determines whether the LED lightbars are under a heavy load by detecting the output current of the driver module, and when the LED lightbar normally operates the protection module outputs a lower first reference voltage to the first comparator of the backlight driver IC. When the LED lightbars are under the heavy load (namely a current flowing through the LED lightbars is greater than the preset second current), the voltage of the output end of each LED lightbar is increased, the voltage of the inverting input end of the first comparator coupled to the output end of the LED lightbar is increased, and a voltage difference between the inverting input and the first reference voltage is reduced. At this moment, the backlight driver IC may reduce the duty cycle of the output signal of the driver pin G of the backlight driver IC and reduce the output voltage of the driver module, which causes that the voltage may be overlow under the heavy load, and expected brightness of the LED lightbar may not be achieved. The protection module outputs a fifth reference voltage as needed under the heavy load, the fifth reference voltage is greater than the first reference voltage. Thus, a voltage difference between the inverting input end and the non-inverting input end of the first comparator is increased as well. The backlight driver IC may increase the duty cycle of the output signal of the driver pin G of the backlight driver IC and increase the output voltage of the driver module, to increase the output voltage of the driver module under the heavy load so as to enable the LED lightbar to achieve expected brightness.

The third aim of the present disclosure is to provide an LED backlight driver circuit capable of improving circuit performance of the driver module of LED lightbars.

The aim of the present disclosure is achieved by the following technical scheme.

An LED backlight driver circuit comprises an LED lightbar and a driver module of the LED lightbar. The driver module comprises a backlight driver IC regulating an output voltage of the driver module, and the backlight driver IC comprises a first comparator correcting the output voltage of the driver module. An output end of each LED lightbar is coupled to an inverting input end of the first comparator, and a non-inverting input end of the first comparator is coupled to a protection module having a variable output voltage.

The protection module comprises a detection unit detecting an output current of the driver module. When the detection unit detects that the output current of the driver module is increased, a voltage output by the protection module to the non-inverting input of the first comparator is increased, when the detection unit detects that the output current of the driver module is reduced, the voltage output by the protection module to the non-inverting input of the first comparator is reduced.

Furthermore, the protection module is a voltage regulator having a continuously adjustable output voltage, and a functional relation between the output voltage of the voltage regulator and the detected current is generated.

A driving method of an LED backlight driver circuit comprises step:

Detecting an output current of a driver module, when the output current of the driver module is increased, a voltage output by a protection module to a non-inverting input of a first comparator is increased, when the output current of the driver module is reduced, the voltage output by the protection module to the non-inverting input of the first comparator is reduced.

An LCD device comprises the LED backlight driver circuit mentioned above.

In the present disclosure, the protection module is used. The protection module determines a current load of the LED lightbar by detecting the output current of the driver module. When the output current of the driver module is reduced, namely brightness of the LED lightbar is reduced, the LED lightbar tends to be under the light load. At this moment, the voltage of the output end of the LED lightbar is reduced, the voltage of the inverting input end of the first comparator coupled to the output end of the LED lightbar is reduced, and the voltage difference between the inverting input and the first reference voltage is reduced. At this moment, the backlight driver IC may increase the duty cycle of the output signal of the driver pin G of the backlight driver IC and increase the output voltage of the driver module, which causes that the voltage may not be overhigh under the light load, and efficiency of the driver module may be reduced.

When the output current of the driver module is reduced, the voltage output by the protection module to the non-inverting input end of the first comparator is reduced. Thus, the voltage difference between the inverting input and the non-inverting input end of the first comparator is reduced as well. The backlight driver IC may reduce the duty cycle of the output signal of the driver pin G of the backlight driver IC and reduce the output voltage of the driver module to increase efficiency of the driver module. By arranging the protection module, the LED backlight driver circuit may have enough brightness and high working efficiency at any time.

When the output current of the driver module is increased, namely the brightness of the LED lightbar is increased, the LED lightbar tends to be under the heavy load, the voltage of the output end of the LED lightbar is increased, the voltage of the inverting input end of the first comparator coupled to the output end of the LED lightbar is increased, and the voltage difference between the inverting input and the first reference voltage is reduced. At this moment, the backlight driver IC may reduce the duty cycle of the output signal of the driver pin G of the backlight driver IC and reduce the output voltage of the driver module, which causes that the voltage may be overlow under the heavy load, and expected brightness of the LED lightbar may not be achieved. When the output current of the driver module is increased, the voltage output by the protection module to the non-inverting input end of the first comparator is increased. Thus, the voltage difference between the inverting input and the non-inverting input end of the first comparator is increased as well. The backlight driver IC may increase the duty cycle of the output signal of the driver pin G of the backlight driver IC and increase the output voltage of the driver module, to enable the LED lightbar to achieve expected brightness.

DETAILED DESCRIPTION

Example 1

Figure 8:
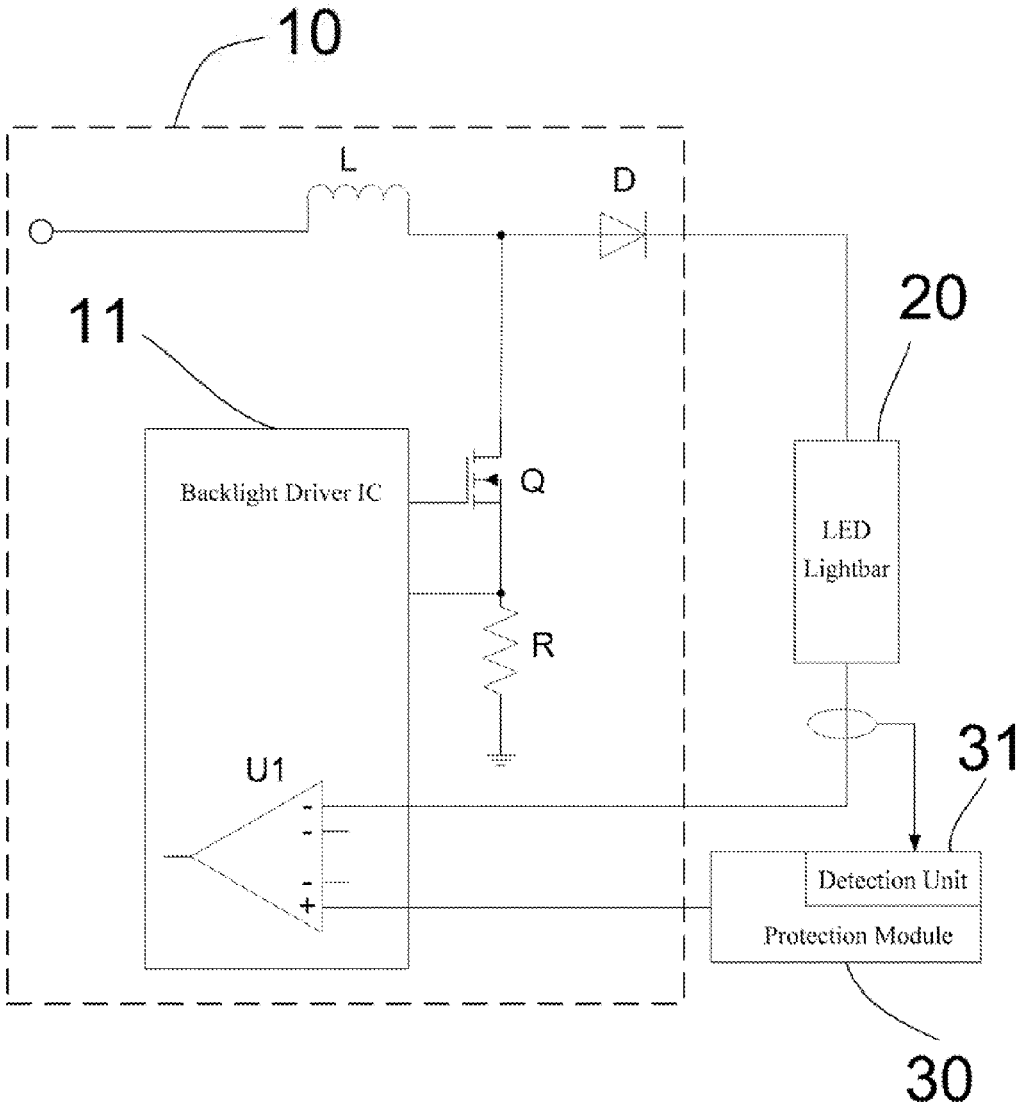
FIG. 8 is a schematic diagram of a first example and a fifth example of the present disclosure.

The present disclosure provides a liquid crystal display (LCD) device comprising a light emitting diode (LED) backlight driver circuit. As shown in FIG. 8, the LED backlight driver circuit comprises an LED lightbar and a driver module of the LED lightbar. The driver module comprises a backlight driver integrated chip (IC) regulating an output voltage of the driver module, and the backlight driver IC comprises a first comparator correcting an output voltage of the driver module. An output end of the LED lightbar is coupled to an inverting input end of the first comparator, and a non-inverting input end of the first comparator is coupled to a protection module. The protection module comprises a detection unit detecting an output current of the driver module.

When the output current of the driver module detected by the detection unit is greater than a preset first current, the protection module outputs a first reference voltage to the non-inverting input end of the first comparator. When the output current of the driver module detected by the detection unit is lower than the preset first current, the protection module outputs a second reference voltage, which is lower than the first reference voltage, to the non-inverting input end of the first comparator.

Figure 3:
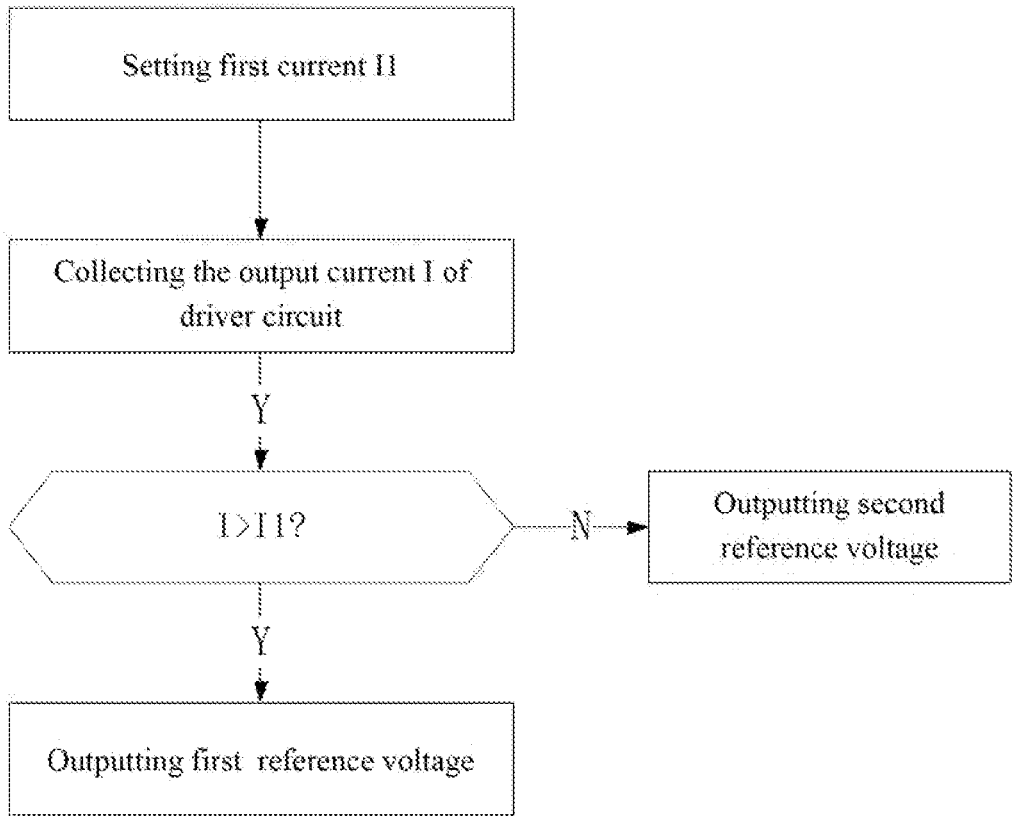
FIG. 3 is a schematic diagram of a method of a first example and a second example of the present disclosure.

As shown in FIG. 3, a driving method of an LED backlight driver circuit comprises step:

Detecting an output current of a driver module, when the output current of the driver module is greater than a preset first current, a protection module outputs a first reference voltage to a non-inverting input end of a first comparator. Otherwise, the protection module outputs a second reference voltage, which is lower than the first reference voltage, to the non-inverting input end of the first comparator.

In the example, the protection module is used. The protection module determines whether the LED lightbar is under a light load by detecting the output current of the driver module, and when the LED lightbar normally operates, the protection module outputs the first reference voltage to the first comparator of the backlight driver IC. When the LED lightbar is under the light load (namely a current flowing through the LED lightbars is lower than the preset first current), the voltage of the output end of the LED lightbar is reduced, the voltage of the inverting input end of the first comparator coupled to the output end of the LED lightbar is reduced, and a voltage difference between the inverting input of the first comparator and the first reference voltage is increased. At this moment, the backlight driver IC may increase a duty cycle of an output signal of a driver pin G of the backlight driver IC and increase the output voltage of the driver module, which causes that the voltage may be overhigh under the light load, and efficiency of the driver module may be reduced. The protection module outputs the second reference voltage as needed under the light load, the second reference voltage is lower than the first reference voltage. Thus, a voltage difference between the inverting input and the non-inverting input end of the first comparator is reduced as well. The backlight driver IC may reduce the duty cycle of the output signal of the driver pin G of the backlight driver IC and reduce the output voltage of the driver module to output a low voltage under the light load and increase efficiency of the driver module.

Example 2

Figure 1:
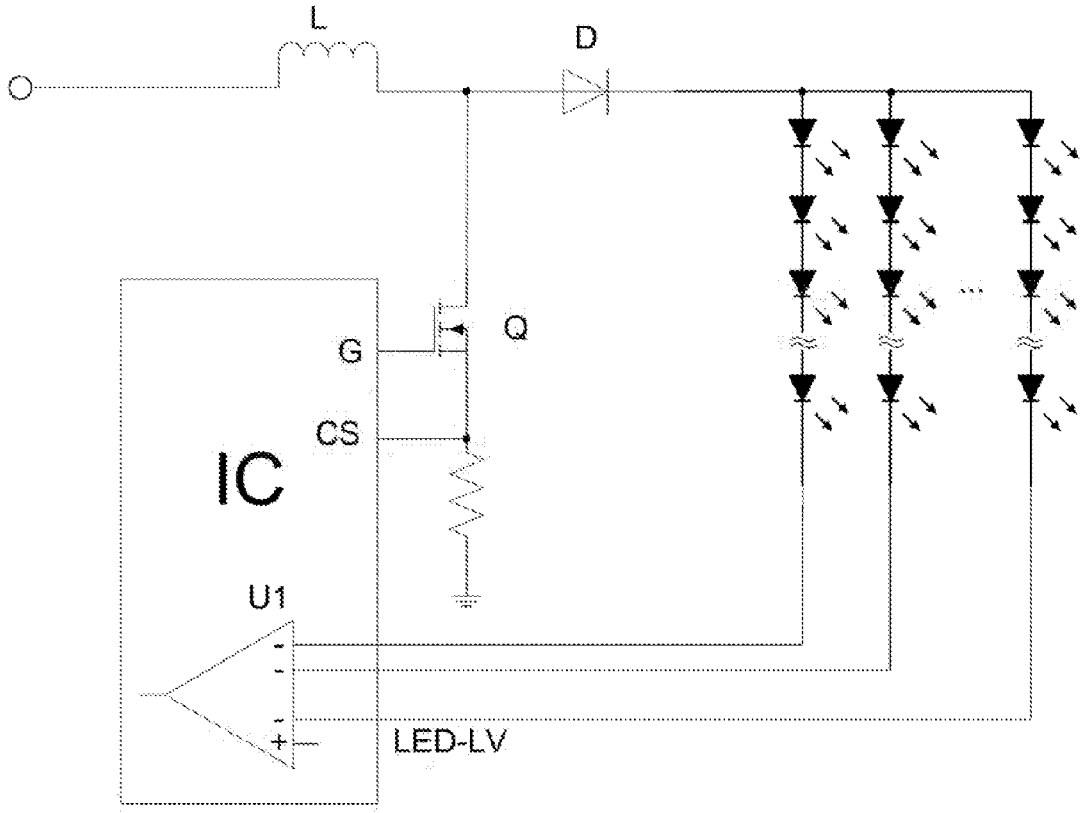
FIG. 1 PRIOR ART
FIG. 1 is a schematic diagram of a typical light emitting diode (LED) backlight driver circuit.
Figure 2:
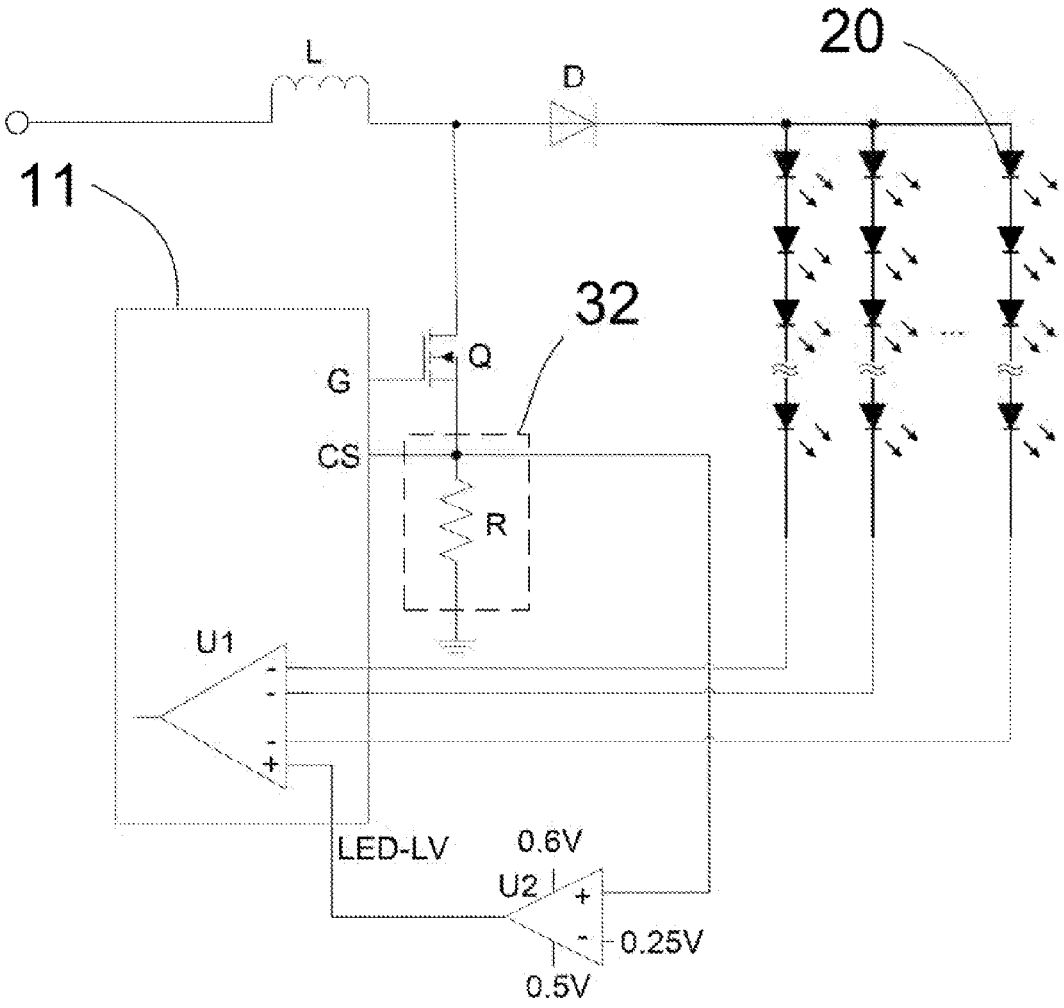
FIG. 2 is a schematic diagram of a second example of the present disclosure.

The example provides a liquid crystal display (LCD) device comprising a light emitting diode (LED) backlight driver circuit. As shown in FIG. 2, an LED backlight driver circuit comprises an LED lightbar 20 and a driver module 10 of the LED lightbar 20. The driver module 10 of the LED lightbar 20 comprises an inductor coupled to a power source and a diode coupled to the inductor. A cathode of the diode is coupled to an input end of the LED lightbar 20, and a controllable switch regulating voltage and a divider resistor are in series connection between an anode of the diode and a ground end of the power source. The driver module 10 comprises a backlight driver integrated chip (IC) 11 regulating an output voltage of the driver module 10. A control end of the controllable switch regulating voltage is coupled to the backlight driver IC 11. The backlight driver IC 11 comprises an overcurrent protection pin and a first comparator U1 correcting the output voltage of the driver module 10, where an end voltage of the divider resistor is coupled to the protection pin. An output end of each LED lightbar 20 is coupled to an inverting input end of the first comparator U1, and a non-inverting input end of the first comparator U1 is coupled to a protection module. The protection module comprises a detection unit detecting an output current of the driver module 10.

The protection module comprises a second comparator, the end voltage of the divider resistor is coupled to a non-inverting input end of the second comparator, an inverting input end of the second comparator is coupled to a third reference voltage, the first reference voltage and the second reference voltage are separately coupled to two excitation ends of the second comparator, and an output end of the second comparator is coupled to the non-inverting input end of the first comparator U1.

When the output current of the driver module detected by the detection unit is greater than a preset first current, the second comparator outputs the first reference voltage, when the output current of the driver module detected by the detection unit is lower than the preset first current, the second comparator outputs the second reference voltage.

Reference values of the reference voltages are as follows: the first reference voltage is 0.6 V, the second reference voltage is 0.5 V, and the third reference voltage is 0.25 V.

The overcurrent protection pin of the backlight driver IC 11 has an overcurrent protection function, which can regulate output voltage when the output current of the driver module is overhigh, to prevent the LED lightbar 20 from being burned out.

As shown in FIG. 3, a driving method of an LED backlight driver circuit comprises step:

Detecting an output current of the driver module, when the output current of the driver module is greater than a preset first current, a protection module outputs a first reference voltage to a non-inverting input end of a first comparator. Otherwise, the protection module outputs a second reference voltage, which is lower than the first reference voltage, to the non-inverting input end of the first comparator.

In the example, the driver module 10 uses a topology structure of a boost circuit, where there is a direct linear relation between a current flowing through the divider resistor of the boost circuit and the output current of the driver module. Therefore, the end voltage of the divider resistor may be coupled to the second comparator to achieve function of a conversion assembly 32 of the detection unit. Thus, the divider resistor achieves voltage collection function of the conversion assembly 32 in addition to achieving function of the boost circuit, thus, the circuit is simple, reusability of devices is high, and reducing costs. When the output current of the driver module detected by the detection unit is greater than the preset first current, the second comparator outputs the first reference voltage, when the output current of the driver module detected by the detection unit is lower than the preset first current, the second comparator outputs the second reference voltage.

Example 3

Figure 4:
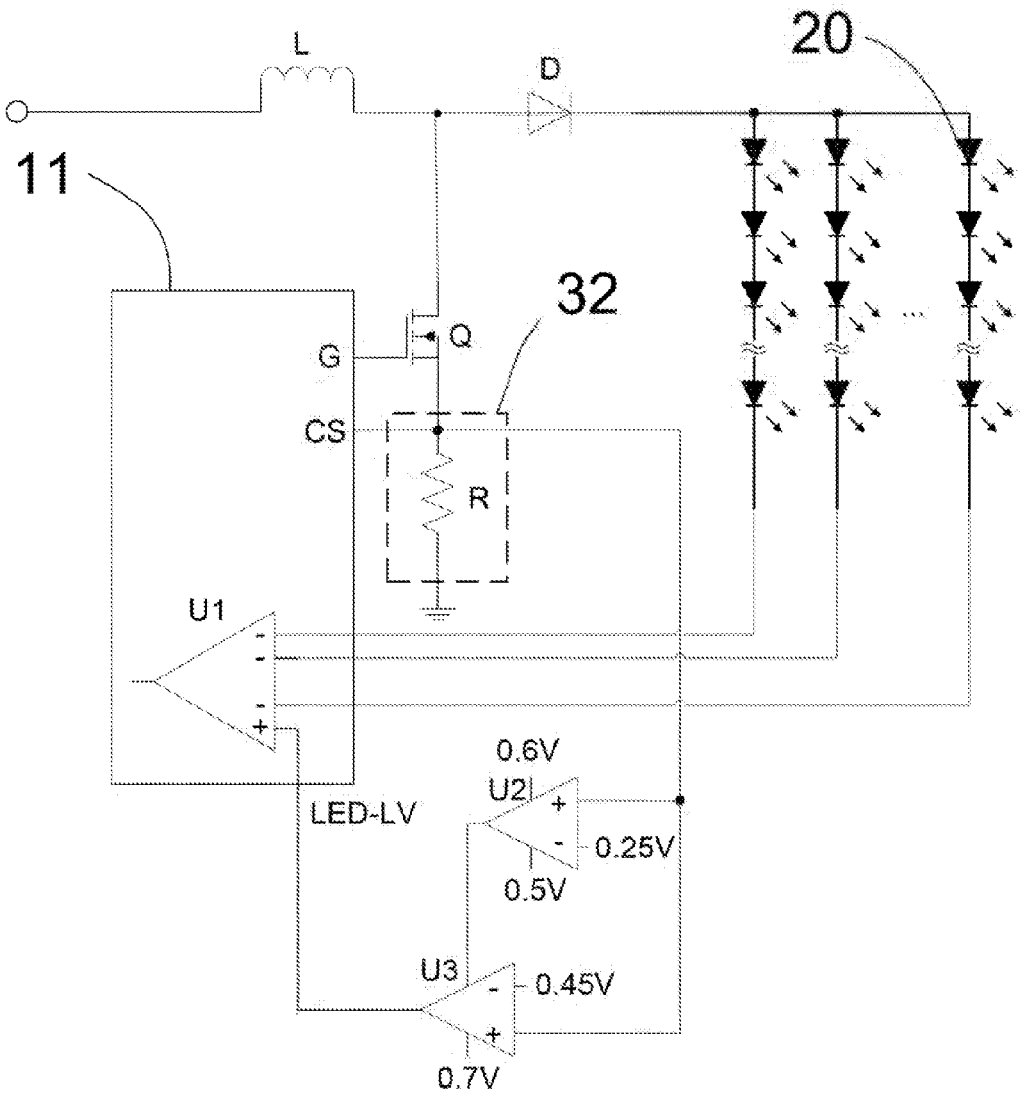
FIG. 4 is a schematic diagram of a third example of the present disclosure.

The present disclosure provides a liquid crystal display (LCD) device comprising a light emitting diode (LED) backlight driver circuit. As shown in FIG. 4, an LED backlight driver circuit comprises an LED lightbar 20 and a driver module 10 of the LED lightbar 20. The driver module 10 of the LED lightbars 20 comprises an inductor coupled to a power source and a diode coupled to the inductor. A cathode of the diode is coupled to an input end of each LED lightbar 20, and a controllable switch regulating voltage and a divider resistor are in series connection between an anode of the diode and a ground end of the power source. The driver module 10 comprises a backlight driver integrated chip (IC) 11 regulating an output voltage of the driver module 10. A control end of the controllable switch regulating voltage is coupled to the backlight driver IC 11. The backlight driver IC 11 comprises an overcurrent protection pin and a first comparator U1 correcting the output voltage of the driver module 10, where an end voltage of the divider resistor is coupled to the protection pin. An output end of the LED lightbar 20 is coupled to an inverting input end of the first comparator U1, and a non-inverting input end of the first comparator U1 is coupled to a protection module. The protection module comprises a detection unit detecting an output current of the driver module 10.

The protection module comprises a second comparator and a third comparator. The end voltage of the divider resistor is coupled to a non-inverting input ends of the second comparator and the third comparator, a non-inverting input end of the second comparator is coupled to a third reference voltage, a first reference voltage and a second reference voltage are separately coupled to two excitation ends of the second comparator, a non-inverting input end of the third comparator is coupled to a fourth reference voltage, an output end of the second comparator is coupled to a first excitation end of the third comparator, and a second excitation end of the third comparator is coupled to a fifth reference voltage. The fourth reference voltage is greater than the third reference voltage, and the fifth reference voltage is greater than the first reference voltage.

When the output current of the driver module detected by the detection unit is greater than a preset second current, the fifth reference voltage output by the third comparator is coupled to the non-inverting input end of the first comparator U1, the second current is greater than a first current.

Reference values of the reference voltages are as follows: the first reference voltage is 0.6 V, the second reference voltage is 0.5 V, the third reference voltage is 0.25 V, the fourth reference voltage is 0.45 V, and the fifth reference voltage is 0.7 V. This is a group of specific reference voltage values, and the reference voltage values are applicable to various backlight drivers of LCD devices.

The overcurrent protection pin of the backlight driver IC 11 has an overcurrent protection function, which can regulate output voltage when the output current of the driver module 10 is overhigh, to prevent the LED lightbar 20 from being burned out.

Suppose a voltage (namely the end voltage of the divider resistor) of the protection pin CS of the backlight driver IC is 0.35 V in normal state, when the LED lightbars are under a light load, a power of the driver module is reduced, and the voltage of the protection pin CS is reduced as well. The voltage of the protection pin is equal to 0.25 V (third reference voltage) is used as a condition to determine whether the LED lightbars are under the light load. Similarly, if the LED lightbars are under a heavy load, the voltage of the protection pin CS is equal to 0.45 V (fourth reference voltage) is used as a condition to determine whether the LED lightbars are under the heavy load:

1. When the LED lightbar is in normal state, the voltage of the protection pin CS is more than 0.25 V and less than 0.45 V, the second comparator U2 outputs the first reference voltage of 0.6 V, and the third comparator U3 outputs the first reference voltage of 0.6 V;

2. When the LED lightbars are under the light load, the voltage of the protection pin CS is less than 0.25 V, the second comparator U2 outputs the second reference voltage of 0.5 V, the third comparator U3 outputs the second reference voltage of 0.5 V as well, and the voltage of the non-inverting input end LED-LV of the first comparator U1 is 0.5 V. By action of the first comparator U1, a duty cycle of an output signal of a driver pin G of the backlight driver IC is reduced, and then the output voltage of the driver module is reduced.

3. When the LED lightbars are under the heavy load, the voltage of the protection pin CS is more than 0.45 V, the second comparator U2 outputs a first reference voltage of 0.6 V, the third comparator U3 outputs the fifth reference voltage of 0.7 V, and the voltage of the non-inverting input end LED-LV of the first comparator U1 is 0.7 V. By action of the first comparator U1, the duty cycle of the output signal of the driver pin G of the backlight driver IC is increased, and then the output voltage of the driver module is increased.

The driver module 10 of the example also uses a topology structure of a boost circuit, where there is a direct linear relation between a current flowing through the divider resistor of the boost circuit and the output current of the driver module 10. Therefore, the end voltage of the divider resistor coupled to the second comparator and the third comparator to achieve function of a conversion assembly 32 of the detection unit. Thus, the divider resistor achieves voltage collection function of the conversion assembly 32 in addition to achieving function of the boost circuit, thus, the circuit is simple, reusability of devices is high, and reducing costs.

A heavy load regulation function is added in the example on the basis of the second example, and the function of the protection module is expanded. When a typical driver module 10 outputs the heavy load (namely a current flowing through the LED lightbars is great, and brightness of the LED lightbars 20 is great), the voltage of the output end of each LED lightbar 20 is increased, the voltage of the inverting input end of the first comparator coupled to the output end of the LED lightbar is increased, and a voltage difference between the inverting input of the first comparator and the first reference voltage is reduced. At this moment, the backlight driver IC 11 may reduce the duty cycle of the output signal of the driver pin G of the backlight driver IC and reduce the output voltage of the driver module, which causes that the voltage may be overlow under the heavy load, and expected brightness of the LED lightbar 20 may not be achieved. The protection module outputs the fifth reference voltage as needed under the heavy load, the fifth reference voltage is greater than the first reference voltage. Thus, a voltage difference between the inverting input end and the non-inverting input end of the first comparator is increased as well. The backlight driver IC 11 may increase the duty cycle of the output signal of the driver pin G of the backlight driver IC and increase the output voltage of the driver module, to output high voltage under the heavy load so as to enable the LED lightbar 20 to achieve the expected brightness. In accordance with conception of the example, more comparators may be added to achieve accurate control. The specific method is as follows: collecting a plurality of preset current within the current variation range of the driver module, corresponding each current to a reference voltage, and outputting the corresponding reference voltage when the corresponding comparator detects that the output current of the driver module is greater than or lower than the corresponding preset current. Thus, multiple groups of reference voltages may be selected by the first comparator, accurate control may be achieved in accordance with the output current of the driver module, and performance of the backlight driver module may be further optimized.

Figure 5:
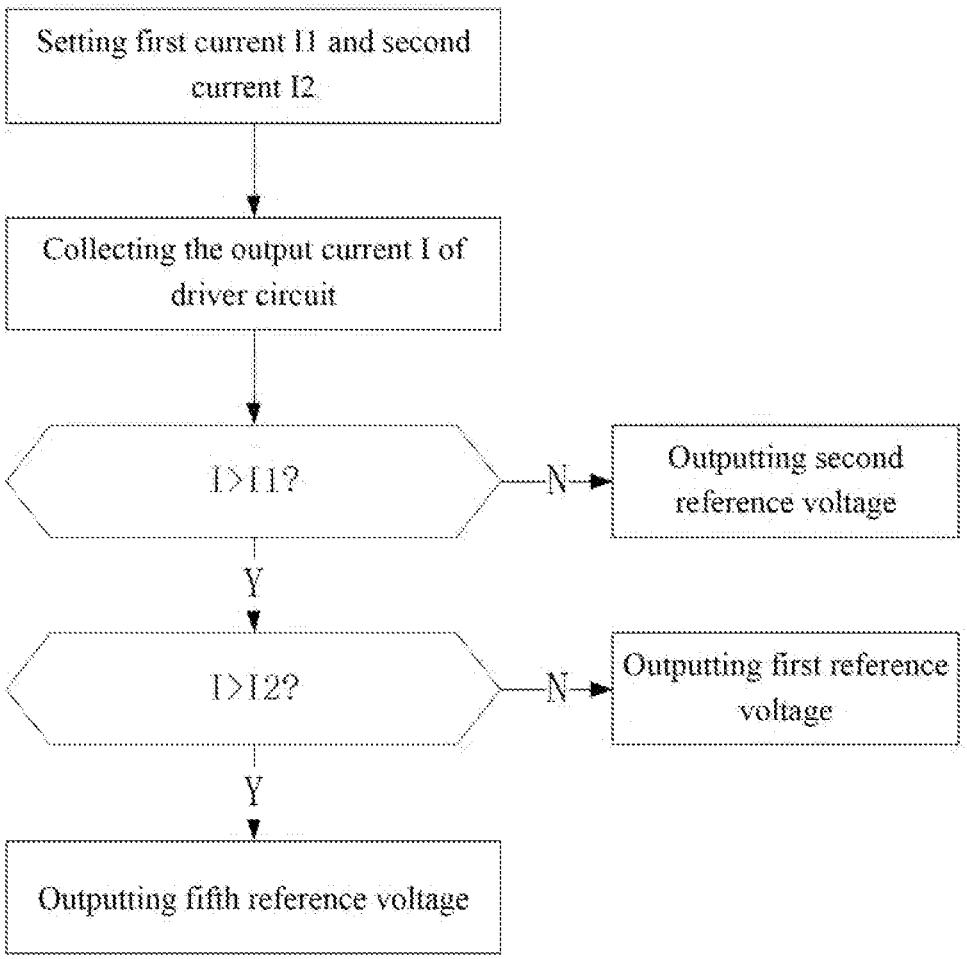
FIG. 5 is a schematic diagram of a method of a third example of present disclosure.

As shown in FIG. 5, a driving method of an LED backlight driver circuit of the example comprises steps:

presetting a first current and a second current being greater than the first current:

detecting an output current of a driver module, when the output current of the driver module is greater than the preset first current, a protection module outputs a first reference voltage to a non-inverting input end of a first comparator. Otherwise, the protection module outputs a second reference voltage, which is lower than the first reference voltage, to the non-inverting input end of the first comparator. When detecting that the output current of the driver module is greater than the second current, the protection module outputs a fifth reference voltage, which is greater than the first reference voltage, to the non-inverting input end of the first comparator. The fifth reference voltage is greater than the first reference voltage, and the first reference voltage is greater than the second reference voltage.

Example 4

Figure 6:
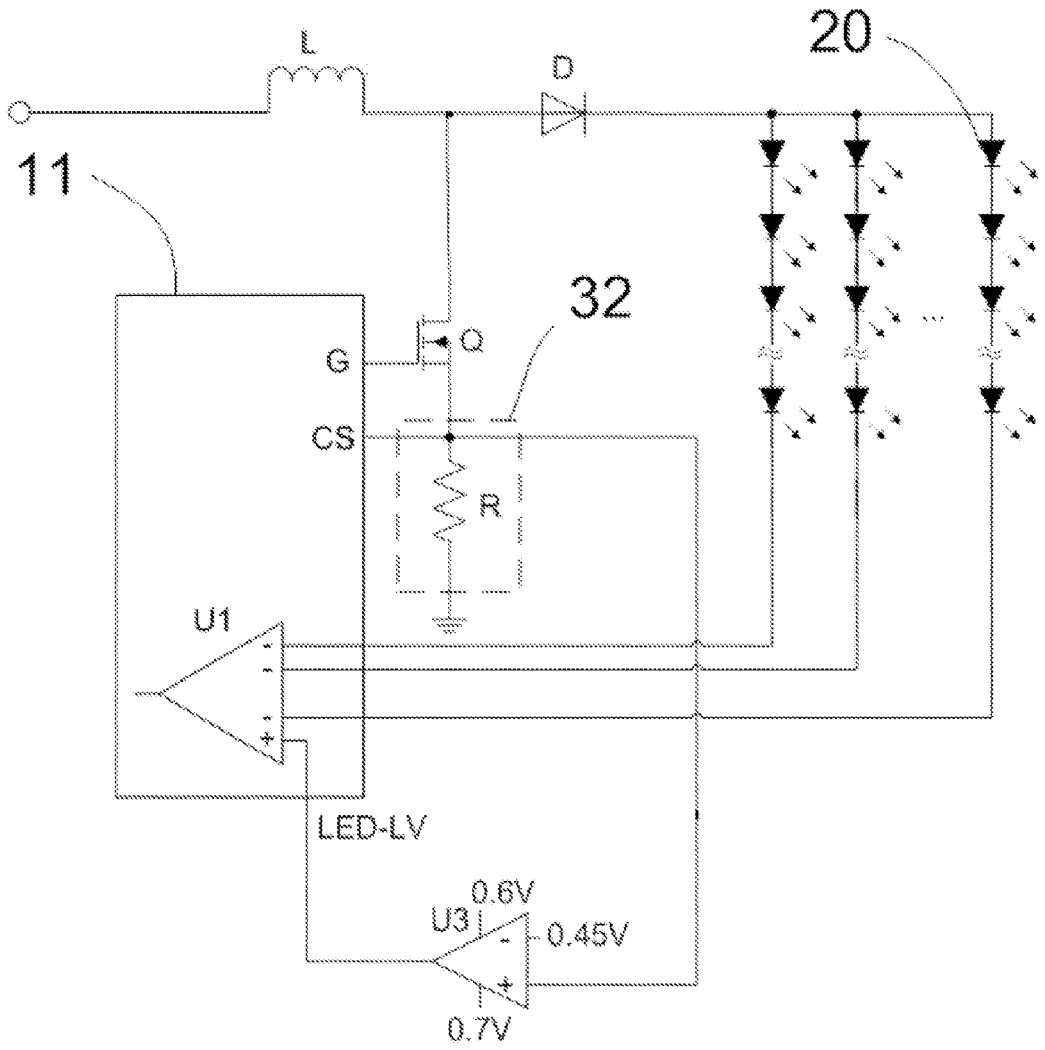
FIG. 6 is a schematic diagram of a fourth example of the present disclosure.

The present disclosure provides a liquid crystal display (LCD) device comprising a light emitting diode (LED) backlight driver circuit. As shown in FIG. 6, an LED backlight driver circuit comprises an LED lightbar and a driver module of the LED lightbars. The driver module comprises a backlight driver integrated chip (IC) regulating an output voltage of the driver module, an inductor coupled to a power source, and a diode coupled to the inductor. A cathode of the diode is coupled to an input end of each LED lightbar, a controllable switch regulating voltage and a divider resistor are in series connection between an anode of the diode and a ground end of the power source in sequence, and a control end of the controllable switch regulating voltage is coupled to the backlight driver IC. The backlight driver IC comprises an overcurrent protection pin and a first comparator correcting the output voltage of the driver module. An output end of the LED lightbar is coupled to an inverting input end of the first comparator, and a non-inverting input end of the first comparator is coupled to a protection module having a variable output voltage.

The protection module comprises a third comparator and a detection unit detecting an output current of the driver module. The detection unit comprises a conversion assembly converting a detected current into a voltage. The conversion assembly is coupled to a non-inverting input end of the third comparator, an inverting input end of the third comparator is coupled to a fourth reference voltage, a first reference voltage and a fifth reference voltage are separately coupled to two excitation ends of the third comparator, and an output end of the third comparator is coupled to the non-inverting input end of the first comparator.

In the example, the conversion assembly and the divider resistor may be repeatedly used, namely an end voltage of the divider resistor is coupled to the non-inverting input end of the third comparator and is coupled to the protection pin of the backlight driver as well.

When the current of the divider resistor is lower than a preset second current, the end voltage of the divider resistor is lower than the fourth reference voltage, and the third comparator outputs the first reference voltage; when the current of the divider resistor is greater than the preset second current, the end voltage of the divider resistor is greater than the fourth reference voltage, and the third comparator outputs the fifth reference voltage.

Reference values of the reference voltages are as follows: the first reference voltage is 0.6 V, the fourth reference voltage is 0.45 V, and the fifth reference voltage is 0.7 V. This is a group of specific reference voltage values, and the reference voltage values are applicable to various backlight drivers of LCD devices.

Figure 7:
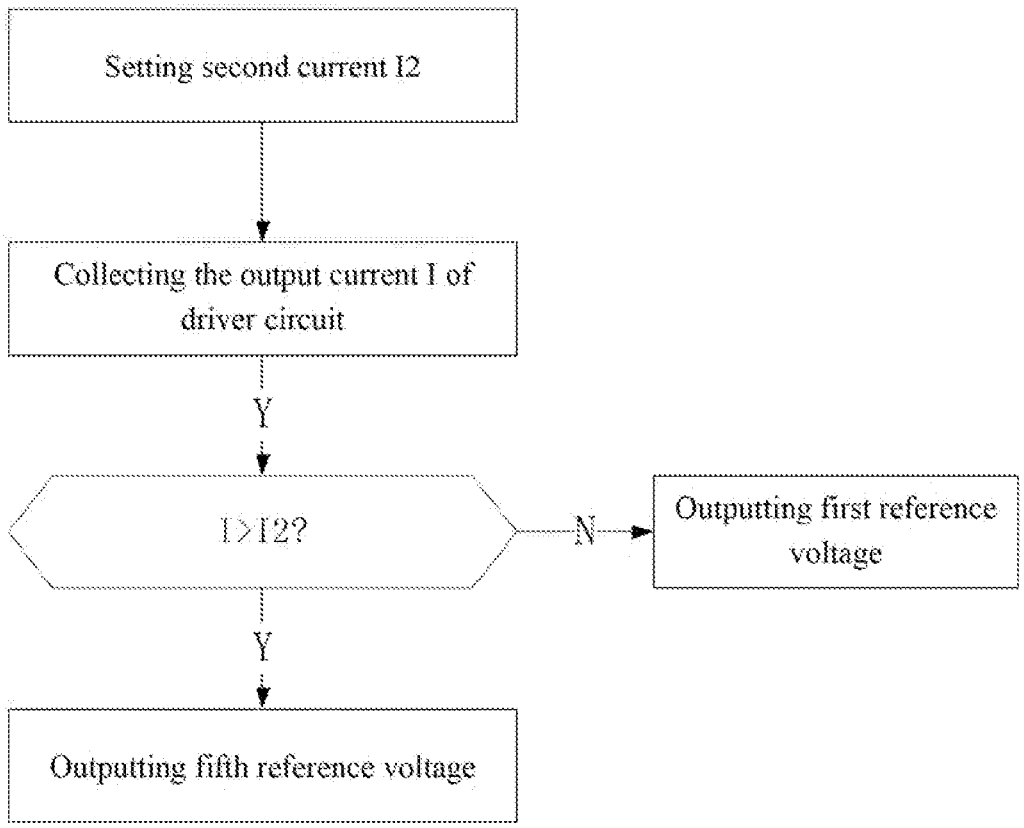
FIG. 7 is a schematic diagram of a method of a fourth example of the present disclosure.

As shown in FIG. 7, a driving method of an LED backlight driver circuit of the example comprises step:

Detecting an output current of a driver module, when the output current of the driver module is lower than a preset first current, a protection module outputs a first reference voltage to a non-inverting input end of a first comparator. Otherwise, the protection module outputs a fifth reference voltage, which is greater than the first reference voltage, to the non-inverting input end of the first comparator.

In the example, the protection module is used. The protection module determines whether the LED lightbars are under a heavy load by detecting the output current of the driver module, if the LED lightbars normally operate, the protection module outputs the first reference voltage to the first comparator of the backlight driver IC, if the LED lightbars are under the heavy load (namely a current flowing through the LED lightbars is greater than the preset second current), the voltage of the output end of the LED lightbar is increased, the voltage of the inverting input end of the first comparator coupled to the output end of the LED lightbar is increased, and a voltage difference between the inverting input and the first reference voltage is reduced. At this moment, the backlight driver IC may reduce a duty cycle of an output signal of a driver pin G of the backlight driver IC and reduce the output voltage of the driver module, which causes that the voltage may be overlow under the heavy load, and expected brightness of the LED lightbars may not be achieved. The protection module outputs the fifth reference voltage as needed under heavy load, the fifth reference voltage is greater than the first reference voltage. Thus, a voltage difference between the inverting input end and the non-inverting input end of the first comparator is increased as well. The backlight driver IC may increase the duty cycle of the output signal of the driver pin G of the backlight driver IC and increase the output voltage of the driver module, to increase the output voltage of the driver module under the heavy load so as to enable the LED lightbars to achieve the expected brightness.

Example 5

The example provides a liquid crystal display (LCD) device comprising a light emitting diode (LED) backlight driver circuit. As shown in FIG. 8, the example provides an LCD device comprising an LED backlight driver circuit. As shown in FIG. 2, the LED backlight driver circuit comprises an LED lightbar 20 and a driver module 10 of the LED lightbar 20. The driver module 10 comprises a backlight driver integrated chip (IC) 11 regulating an output voltage of the driver module 10, and the backlight driver IC comprises a first comparator U1 correcting the output voltage of the driver module 10. An output end of each LED lightbar 20 is coupled to an inverting input end of the first comparator U1, and a non-inverting input end of the first comparator U1 is coupled to a protection module 30 having a variable output voltage.

The protection module 30 comprises a detection unit 31 detecting an output current of the driver module 10. When the detection unit 31 detects that the output current of the driver module 10 is increased, a voltage output by the protection module 30 to the non-inverting input of the first comparator U1 is increased, when the detection unit 31 detects that the output current of the driver module 10 is reduced, the voltage output by the protection module 30 to the non-inverting input of the first comparator U1 is reduced.

Figure 9:
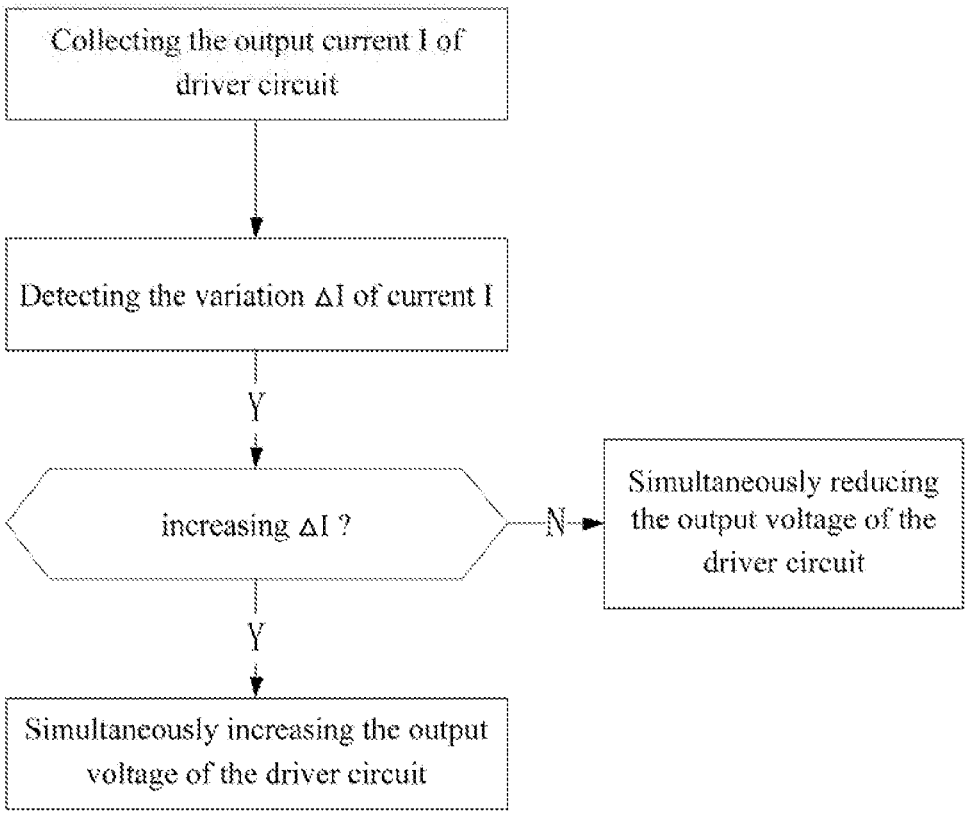
FIG. 9 is a schematic diagram of a method of a fifth example of the present disclosure.

As shown in FIG. 9, the example further provides a driving method of the LED backlight driver circuit mentioned above, comprising step:

Detecting an output current of a driver module, when the output current is increased, a voltage output by a protection module to a non-inverting input of a first comparator U1 is increased, when the output current is reduced, the voltage output by the protection module to the non-inverting input of the first comparator U1 is reduced.

In the example, the protection module 30 is used. The protection module 30 determines whether the LED lightbar 20 is under a light load or a heavy load by detecting the output current of the driver module 10. When the output current of the driver module 10 is reduced, namely brightness of the LED lightbars 20 is reduced, the LED lightbar 20 tends to be under the light load. At this moment, a voltage of the output end of each LED lightbar 20 is reduced, a voltage of the inverting input end of the first comparator U1 coupled to the output end of the LED lightbar 20 is reduced, and a voltage difference between the inverting input and the first reference voltage is reduced. At this moment, the backlight driver IC 11 may increase a duty cycle of an output signal of a driver pin G of the backlight driver IC and increase the output voltage of the driver module, which causes that the voltage may be overhigh under the light load, and efficiency of the driver module 10 may be reduced. When the output current of the driver module 10 is reduced, the voltage output by the protection module 30 to the non-inverting input end of the first comparator U1 is reduced. Thus, the voltage difference between the inverting input and the non-inverting input end of the first comparator U1 is reduced as well. The backlight driver IC 11 may reduce the duty cycle of the output signal of the driver pin G of the backlight driver IC and reduce the output voltage of the driver module 10 to increase efficiency of the driver module 10.

When the output current of the driver module 10 is increased, namely the brightness of LED lightbar 20 is increased, the LED lightbar 20 tends to be under the heavy load, the voltage of the output end of each LED lightbar 20 is increased, the voltage of the inverting input end of the first comparator coupled to the output end of the LED lightbar 20 is increased, and the voltage difference between the inverting input and the first reference voltage is reduced. At this moment, the backlight driver IC may reduce the duty cycle of the output signal of the driver pin G of the backlight driver IC and reduce the output voltage of the driver module, causing that the voltage may be overlow under the heavy load, and expected brightness of the LED lightbars 20 may not be achieved. When the output current of the driver module 10 is increased, the voltage output by the protection module 30 to the non-inverting input end of the first comparator U1 is increased. Thus, the voltage difference between the inverting input and the non-inverting input end of the first comparator U1 is increased as well. The backlight driver IC 11 may increase the duty cycle of the output signal of the driver pin G of the backlight driver IC and increase the output voltage of the driver module 10, to enable the LED lightbars 20 to achieve the expected brightness.

The protection module of the example is a voltage regulator having a continuously adjustable output voltage, and there is a functional relation between the output voltage of the voltage regulator and the detected current. Thus, the output voltage of the protection module may be increased or reduced with the current of the driver module.

The invention is described in detail in accordance with the above contents with the specific exemplary examples. However, this invention is not limited to the specific examples. For the ordinary technical personnel of the technical field of the present disclosure, on the premise of keeping the conception of the present disclosure, the technical personnel can also make simple deductions or replacements, and all of which should be considered to belong to the protection scope of the present disclosure.

We claim:

1. A light emitting diode (LED) backlight driver circuit, comprising:

an LED lightbar; and a driver module driving the LED lightbar;

wherein the driver module comprises a backlight driver integrated chip (IC) regulating an output voltage of the driver module, and the backlight driver IC comprises a first comparator correcting the output voltage of the driver module; an output end of each LED lightbar is coupled to an inverting input end of the first comparator, and a non-inverting input end of the first comparator is coupled to a protection module having a variable output voltage;

wherein the protection module comprises a detection unit detecting an output current of the driver module;

wherein when the output current of the driver module detected by the detection unit is greater than a preset first current, the protection module outputs a first reference voltage to the non-inverting input end of the first comparator, and when the output current of the driver module detected by the detection unit is lower than the preset first current, the protection module outputs a second reference voltage, which is lower than the first reference voltage, to the non-inverting input end of the first comparator, wherein the protection module comprises a second comparator, and the detection unit comprises a conversion assembly converting the detected current into a voltage, the conversion assembly is coupled to a non-inverting input end of the second comparator; an inverting input of the second comparator is coupled to a third reference voltage; the first reference voltage and the second reference voltage are separately coupled to two excitation ends of the second comparator; an output end of the second comparator is coupling to the non-inverting input of the first comparator;

when the output current of the driver module detected by the detection unit is greater than the preset first current, the second comparator outputs the first reference voltage; when the output current of the driver module detected by the detection unit is lower than the preset first current, the second comparator outputs the second reference voltage.

2. The light emitting diode (LED) backlight driver circuit of claim 1, wherein the driver module of the LED lightbar comprises an inductor coupled to a power source and a diode coupled to the inductor; a cathode of the diode is coupled to an input end of the LED lightbar, a controllable switch regulating voltage and a divider resistor are in series connection between an anode of the diode and a ground end of the power source in sequence, a control end of the controllable switch regulating voltage is coupled to the backlight driver IC, and an end voltage of the divider resistor is coupled to the non-inverting input end of the second comparator.

3. The light emitting diode (LED) backlight driver circuit of claim 1, wherein the protection module further comprises a third comparator; the conversion assembly of the detection unit is coupled to a non-inverting input end of the third comparator, an inverting input end of the third comparator is coupled to a fourth reference voltage, and the output end of the second comparator is coupled to a first excitation end of the third comparator; a second excitation end of the third comparator is coupled to a fifth reference voltage; the fourth reference voltage is greater than the third reference voltage, and the fifth reference voltage is greater than the first reference voltage;

when the output current of the driver module detected by the detection unit is greater than a preset second current, the fifth reference voltage output by the third comparator is coupled to the non-inverting input end of the first comparator; the second current being greater than the first current.

4. The light emitting diode (LED) backlight driver circuit of claim 3, wherein the driver module of the LED lightbar comprises an inductor coupled to a power source, and a diode coupled to the inductor; a cathode of the diode is coupled to an input end of each LED lightbar, a controllable switch regulating voltage and a divider resistor are in series connection between an anode of the diode and a ground end of the power source in sequence, a control end of the controllable switch regulating voltage is coupled to the backlight driver IC, and an end voltage of the divider resistor is coupled to the non-inverting input ends of the second comparator and the third comparator.

5. The light emitting diode (LED) backlight driver circuit of claim 3, wherein the first reference voltage is 0.6 V, the second reference voltage is 0.5 V, the third reference voltage is 0.25 V, the fourth reference voltage is 0.45 V, and the fifth reference voltage is 0.7 V.

6. The light emitting diode (LED) backlight driver circuit of claim 2, wherein the backlight driver IC comprises an overcurrent protection pin; the end voltage of the divider resistor is coupled to the protection pin.

7. A light emitting diode (LED) backlight driver circuit, comprising:

an LED lightbar; and a driver module of the LED lightbar;

wherein the driver module comprises a backlight driver integrated chip (IC) regulating an output voltage of the driver module, and the backlight driver IC comprises a first comparator correcting the output voltage of the driver module; an output end of each LED lightbar is coupled to an inverting input end of the first comparator, and a non-inverting input end of the first comparator is coupled to protection module having a variable output voltage:

wherein the protection module comprises a detection unit detecting an output current of the driver module;

wherein when the output current of the driver module detected by the detection unit is lower than a preset second current, the protection module outputs a first reference voltage to the non-inverting input end of the first comparator, when the output current of the driver module detected by the detection unit is greater than the preset second current, the protection module outputs a fifth reference voltage, which is greater than the first reference voltage, to the non-inverting input end of the first comparator, wherein the protection module comprises a third comparator, and the detection unit comprises a conversion assembly converting the detected current into a voltage, the conversion assembly is coupled to a non-inverting input end of the third comparator; an inverting input end of the third comparator is coupled to a fourth reference voltage; the first reference voltage and the fifth reference voltage are separately coupled to two excitation ends of the third comparator; an output end of the third comparator is coupled to the non-inverting input end of the first comparator;

when the output current of the driver module detected by the detection unit is lower than the preset second current, the third comparator outputs the first reference voltage; when the output current of the driver module detected by the detection unit is greater than the preset second current the third comparator outputs the fifth reference voltage.

8. The light emitting diode (LED) backlight driver circuit of claim 7, wherein the backlight driver IC comprises an overcurrent protection pin; the driver module of the LED lightbar comprises an inductor coupled to a power source and a diode coupled to the inductor; a cathode of the diode is coupled to an input end of each LED lightbar, a controllable switch regulating voltage and a divider resistor are in series connection between an anode of the diode and a ground end of the power source in sequence, a control end of the controllable switch regulating voltage is coupled to the backlight driver IC, and the end voltage of the divider resistor is coupled to the non-inverting input end of the third comparator and the protection pin of the backlight driver IC.

9. The light emitting diode (LED) backlight driver circuit of claim 7, wherein the first reference voltage is 0.6 V, the fourth reference voltage is 0.45 V, and the fifth reference voltage is 0.7 V.

10. A light emitting diode (LED) backlight driver circuit, comprising:

an LED lightbar; and a driver module of the LED lightbar;

wherein the driver module comprises a backlight driver IC regulating an output voltage of the driver module, and the backlight driver IC comprises a first comparator correcting the output voltage of the driver module; an output end of each LED lightbar is coupled to an inverting input end of the first comparator; an non-invert input end of the first comparator is coupled to a protection module having a variable output voltage;

wherein the protection module comprises a detection unit detecting an output current of the driver module; when the detection unit detects that the output current of the driver module is increased, a voltage output by the protection module to the non-inverting input of the first comparator is increased when the detection unit detects that the output current of the driver module is reduced, the voltage output by the protection module to the non-inverting input of the first comparator is reduced, wherein the protection module comprises a second comparator, and the detection unit comprises a conversion assembly converting the detected current into a voltage, the conversion assembly is coupled to a non-inverting input end of the second comparator; an inverting input of the second comparator is coupled to a third reference voltage; the first reference voltage and the second reference voltage are separately coupled to two excitation ends of the second comparator; an output end of the second comparator is coupling to the non-inverting input of the first comparator;

when the output current of the driver module detected by the detection unit is greater than the preset first current, the second comparator outputs the first reference voltage; when the output current of the driver module detected by the detection unit is lower than the preset first current, the second comparator outputs the second reference voltage.

11. The light emitting diode (LED) backlight driver circuit of claim 10, wherein the protection module is a voltage regulator having a continuously adjustable output voltage, and a functional relation between the output voltage of the voltage regulator and the detected current is generated.

12. The light emitting diode (LED) backlight driver circuit of claim 4, wherein the backlight driver IC comprises an overcurrent protection pin; the end voltage of the divider resistor is coupled to the protection pin.

* * * * *